US010315823B2

(12) United States Patent
Murdick et al.

(10) Patent No.: US 10,315,823 B2
(45) **Date of Patent: *Jun. 11, 2019**

(54) MANUALLY OPENABLE SEALED OVERWRAP AND TRAY

(71) Applicant: Bemis Company, Inc., Neenah, WI (US)

(72) Inventors: Brian K. Murdick, Columbus, OH (US); Keith A. Klipstine, Appleton, WI (US)

(73) Assignee: Bemis Company, Inc., Neenah, WI (US)

( * ) Notice: Subject to any disclaimer, the term of this patent is extended or adjusted under 35 U.S.C. 154(b) by 169 days.

This patent is subject to a terminal disclaimer.

(21) Appl. No.: 14/782,613

(22) PCT Filed: Apr. 12, 2013

(86) PCT No.: PCT/US2013/036376

§ 371 (c)(1),
(2) Date: Oct. 6, 2015

(87) PCT Pub. No.: WO2014/168630

PCT Pub. Date: Oct. 16, 2014

(65) Prior Publication Data

US 2016/0068322 A1 Mar. 10, 2016

(51) Int. Cl.

| | |
|---|---|
| ***B65D 65/40*** | (2006.01) |
| ***B65D 75/30*** | (2006.01) |
| ***B65D 75/58*** | (2006.01) |
| ***B65D 77/00*** | (2006.01) |
| ***B65D 77/20*** | (2006.01) |
| ***B65D 81/34*** | (2006.01) |

(52) U.S. Cl.
CPC ..... *B65D 75/5838* (2013.01); *B65D 65/40* (2013.01); *B65D 75/30* (2013.01); *B65D 77/003* (2013.01); *B65D 77/2024* (2013.01); *B65D 81/3453* (2013.01); *B65D 2577/2091* (2013.01)

(58) Field of Classification Search
CPC .... B65D 75/5838; B65D 75/30; B65D 65/40; B65D 77/003; B65D 77/2024; B65D 81/3453; B65D 2577/2091; B65D 31/04; B65D 81/3881; B65D 5/522
USPC ..... 206/459.5, 484, 484.2
See application file for complete search history.

(56) References Cited

U.S. PATENT DOCUMENTS 4,483,125 A 11/1984 Suga
4,625,495 A 12/1986 Holovach
(Continued)

FOREIGN PATENT DOCUMENTS

FR 2761348 A1 10/1998
WO 9609967 4/1996
(Continued)

*Primary Examiner* — Anthony D Stashick
*Assistant Examiner* — James M Van Buskirk
(74) *Attorney, Agent, or Firm* — Amy L. De Coster

(57) ABSTRACT

The present invention relates to improved manually openable packages which include a rigid or semi-rigid tray having a single thermoplastic overwrap comprising a polymeric laminate surrounding the tray and having a front panel and an opposing back panel. The inventive packages also include a continuous seal circumscribing a recessed cavity of the tray which comprises a heat seal formed by heat sealing a portion of the front panel to the peripheral flange of the tray.

20 Claims, 5 Drawing Sheets

(56) References Cited

U.S. PATENT DOCUMENTS

| | | | | |
|---|---|---|---|---|
| 4,660,721 | A * | 4/1987 | Mykleby | A61L 2/26 206/438 |
| 4,703,148 | A | 10/1987 | Mikulski et al. | |
| 4,786,513 | A | 11/1988 | Monforton et al. | |
| 4,874,620 | A | 10/1989 | Mendenhall et al. | |
| 4,939,332 | A | 7/1990 | Hahn | |
| 5,565,228 | A | 10/1996 | Gics | |
| 5,958,484 | A | 9/1999 | Gics | |
| 6,818,873 | B2 | 11/2004 | Savage et al. | |
| 6,843,037 | B2 | 1/2005 | Nolfi, Jr. | |
| 7,032,757 | B2 | 4/2006 | Richards et al. | |
| 7,476,830 | B2 | 1/2009 | Middleton et al. | |
| 7,541,562 | B2 | 6/2009 | Cole et al. | |
| 8,302,528 | B2 | 11/2012 | Pawlick et al. | |
| 9,790,014 | B2 | 10/2017 | Pilzecker | |
| 2005/0269386 | A1 | 12/2005 | Fisher et al. | |

FOREIGN PATENT DOCUMENTS

| | | | |
|---|---|---|---|
| WO | 9935039 | | 7/1999 |
| WO | 2005077783 | A1 | 8/2005 |
| WO | 2011146627 | A1 | 11/2011 |
| WO | 2012166381 | A1 | 12/2012 |

* cited by examiner

MANUALLY OPENABLE SEALED OVERWRAP AND TRAY

BACKGROUND OF THE INVENTION

The present invention relates to packages including a tray surrounded by a single thermoplastic overwrap and particularly to packages having a single thermoplastic overwrap hermetically heat sealed to the tray that includes a manual tear opening feature.

Various concerns arise in connection with the manufacture and use of food non-food packages. One area of concern is with respect to the cost of packaging components and the efficiency that they are assembled with the food items. For example, current packaging containers for microwavable meals include a tray on which a food item is supported and a separate plastic lidding film which is heat sealed to the rim of the tray to hermetically seal the food item within the package. Often, a separate paperboard sleeve-type overwrap or paperboard carton is required which surrounds the sealed tray and provides a surface for product information and/or cooking instructions. It would be highly desirable minimize the cost of the packaging components by eliminating the paperboard sleeve-type overwrap or paperboard carton.

Another area of concern is with respect to ease of use during cooking of the food items and subsequent dispensing of the food items once cooked. When an air-tight unvented microwave package is heated in a microwave oven, pressure builds up in the sealed package holding the product. After a critical internal pressure is reached, the package can explode, spattering its contents over the oven interior. Before cooking the food item, the consumer is required to puncture the lidding film or remove a portion of the lidding film in order to reduce the internal pressure within the package and prevent explosion of the package during heating. Packaging which self-vents is also highly desirable.

There is a need in the art for improved packages that address at least some of the above concerns, and other concerns related to manufacture and use of the packages.

SUMMARY OF THE INVENTION

The present invention is concerned with improved manually openable packages which include a rigid or semi-rigid tray having a base and at least one sidewall extending from the base thereby forming a recessed cavity; wherein the at least one sidewall comprises a peripheral flange extending generally perpendicularly from the at least one sidewall and which circumscribes the recessed cavity. The inventive packages also include a single thermoplastic overwrap comprising a polymeric laminate surrounding the tray and having a front panel and an opposing back panel having a longitudinal seal disposed underneath the base of the tray, a first leading end seal positioned substantially transverse to the longitudinal seal, and an opposing second trailing end seal positioned substantially transverse to the longitudinal seal. The overwrap further includes a first side edge and an opposing second side edge, where the side edges are positioned between the first leading end seal and the opposing second trailing end seal. The packages also include a seal continuously circumscribing the recessed cavity which comprises an inner perimeter defined by a heat seal formed by heat sealing a portion of the front panel to the peripheral flange. Advantageously, the inventive packages include a removable portion of the front panel having an outer periphery inside the inner perimeter of the hermetic seal and defined by a line of weakness in the polymeric laminate. The inventive packages of the present invention may be self-venting whereby the line of weakness is configured to rupture and release steam in response to overpressure generated during heating of a food item in a microwave oven. The line of weakness is configured to rupture at approximately the midpoint of the line of weakness. The inventive packages may also be used for aseptic, retortable, and/or cook-in applications.

DETAILED DESCRIPTION OF THE INVENTION

Figure 1:
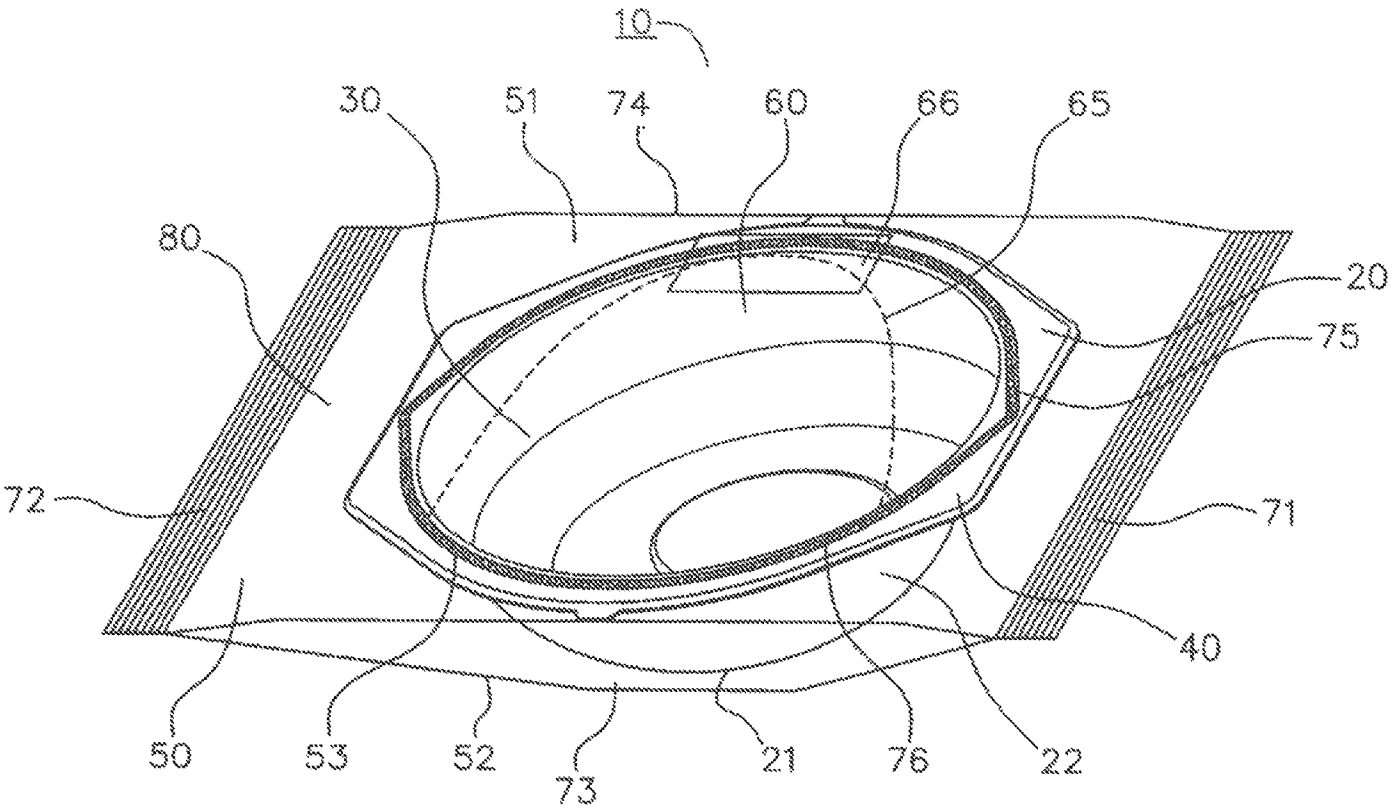
FIG. 1 depicts an isometric top perspective view of one embodiment the present invention.
Figure 2:
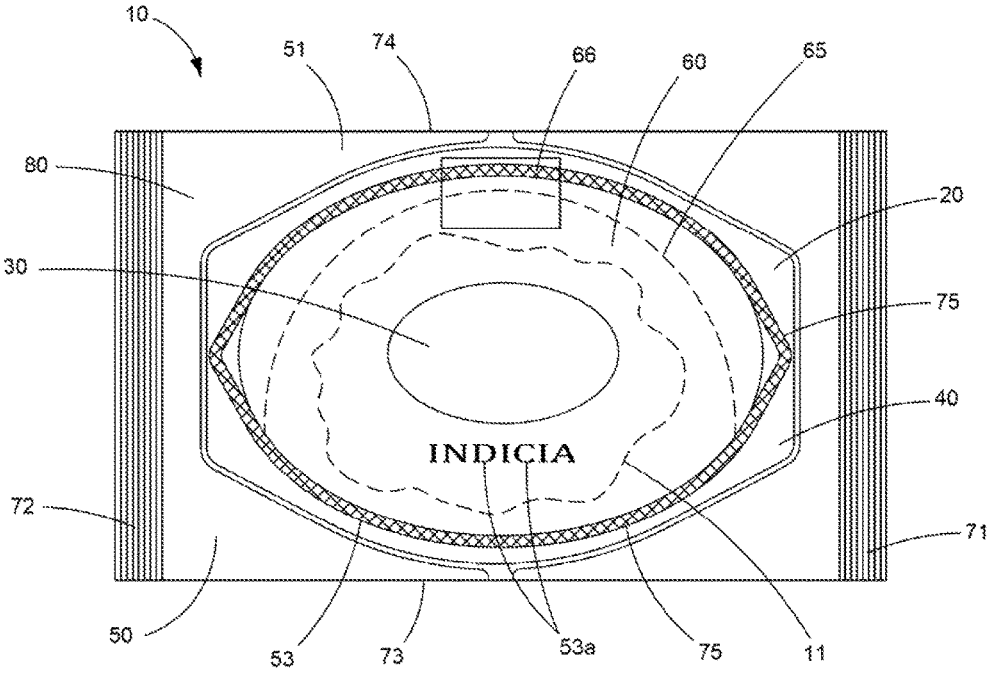
FIG. 2 depicts a top-down view of the embodiment of the present invention depicted in FIG. 1.

Referring now more particularly to FIGS. 1-4 of the drawings, a preferred embodiment of package 10 embodying the present invention is shown. The package 10 comprises a rigid or semi-rigid tray 20 having a recessed cavity 30 and a peripheral flange 40 circumscribing recessed cavity 30. The tray 20 can be made of any suitable material, however, it is preferred that the tray 20 be made of a plastic. Most preferably, the plastic is crystallized polyethylene terephthalate ("CPET") although other plastics, such as, amorphous polyethylene terephthalate ("APET"), polypropylene or polystyrene may be used.

The tray 20 has a base 21 and a sidewall 22 extending from the base 21 which forms recessed cavity 30. The sidewall 22 of tray 20 terminates at peripheral flange 40 which circumscribes recessed cavity 30. It will be appreciated that tray 20 may be of the shape as shown in FIGS. 1-4 or any other shape, such as, for example, rectangular, square, circular or polygon depending on both functional and aesthetic requirements. It will be further appreciated that tray 20 may be configured to include two or more recessed cavities depending again on both functional and aesthetic requirements.

Figure 3:
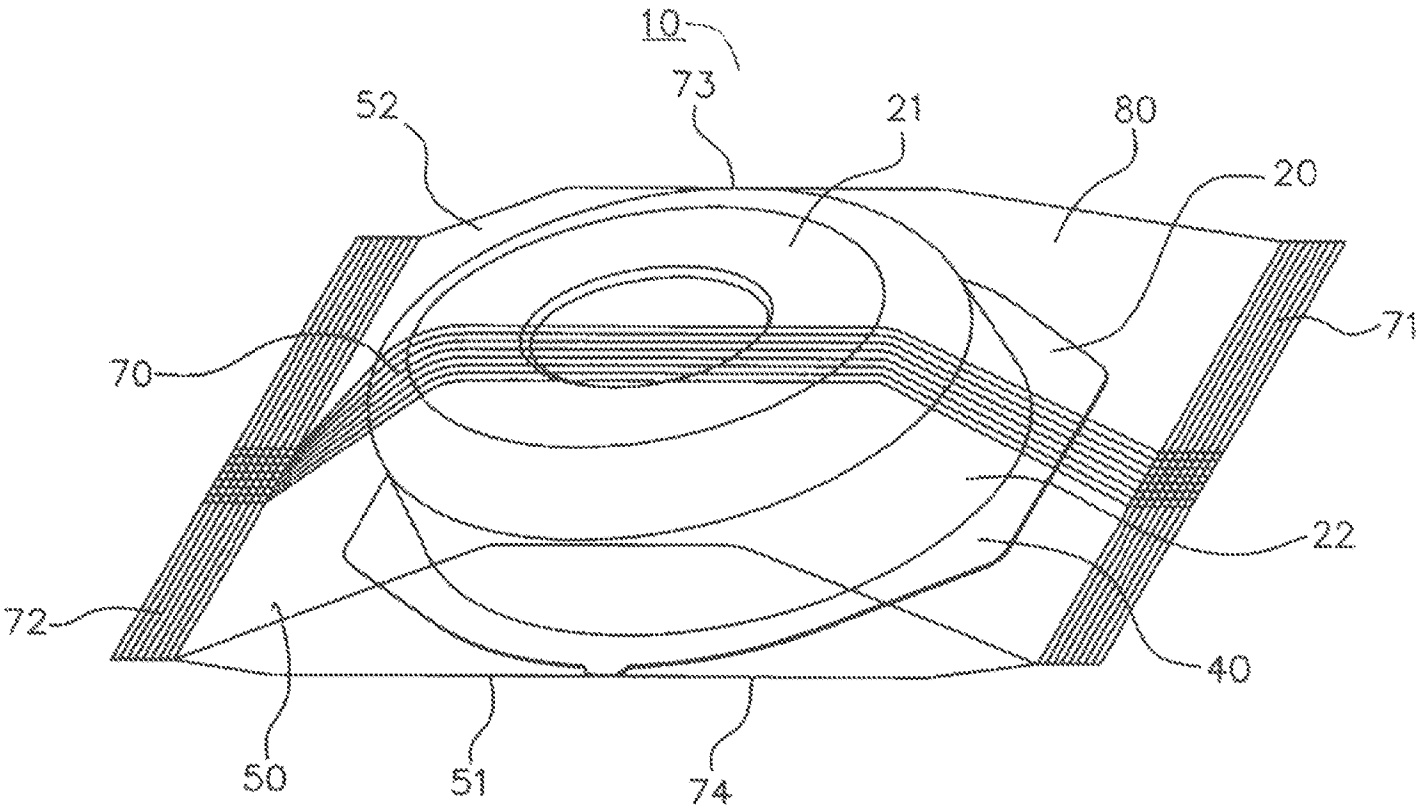
FIG. 3 depicts an isometric bottom perspective view of one embodiment of the present invention.
Figure 4:
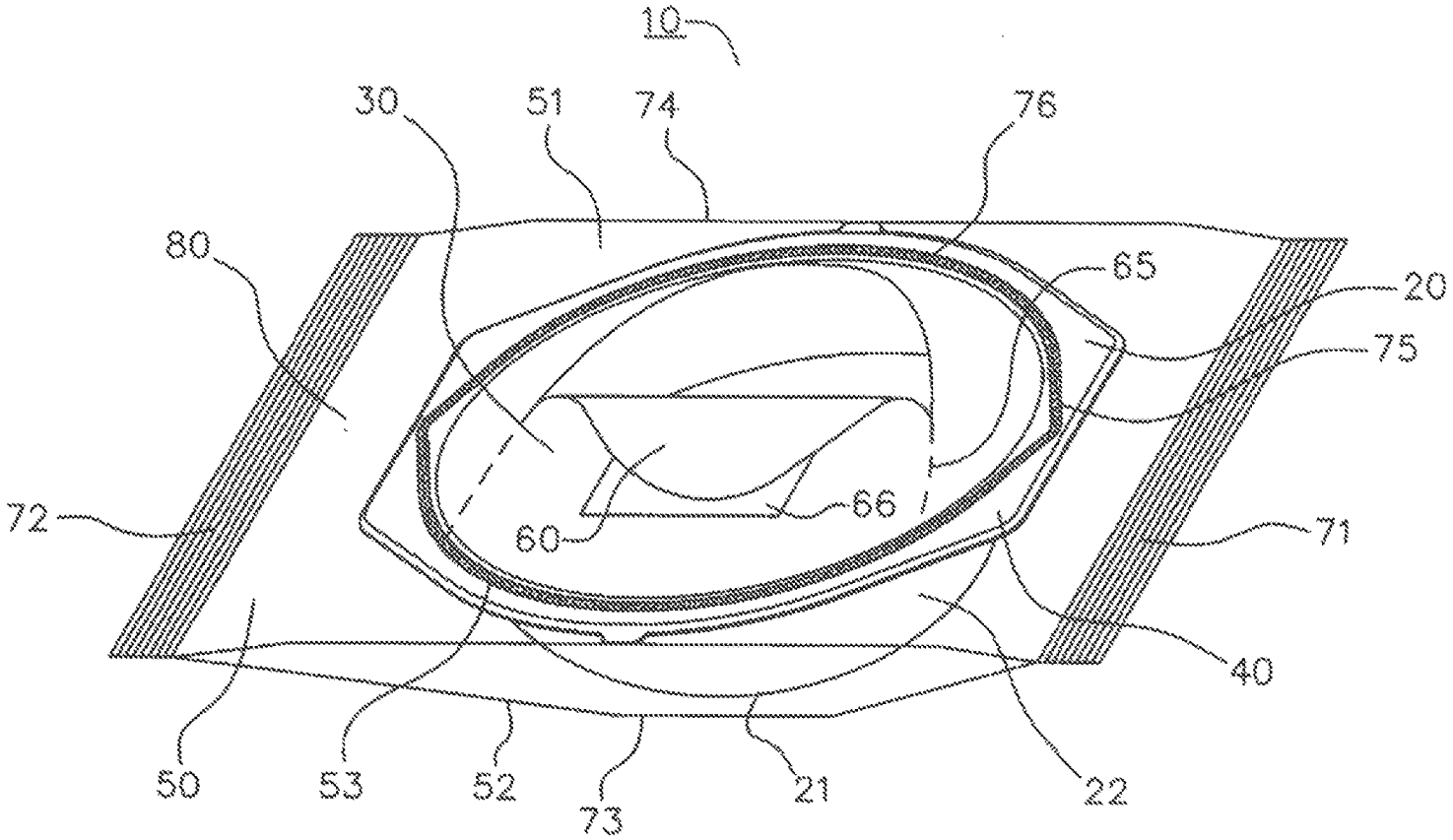
FIG. 4 depicts an isometric top perspective view of one embodiment of the present invention in the opened state.

As depicted, a single thermoplastic overwrap 50 comprises a polymeric laminate 80 and encloses tray 20 and includes a front panel 51 and an opposing back panel 52 (shown in FIG. 3). Back panel 52 is disposed underneath the base 21 of tray 20 and includes a longitudinal seal 70 (shown in FIG. 3). Preferably, longitudinal seal 70 is a heat seal or cold seal, and more preferably, a heat seal. Longitudinal seal 70 may be configured as either a fin seal or lap seal, and preferably as a fin seal. As used herein, the term "heat seal" refers to welding or melting of two polymeric surfaces together by the application of heat and pressure. It will be appreciated by those skilled in the art that heat seals can be hermetic seal meaning that they prevent the ingress of air and/or moisture through the seal. As used herein, the term "cold seal" refers to joining of two surfaces by the application of glue or other adhesive. Cold seal adhesives are well-known in the art. Thermoplastic overwrap 50 further comprises a first leading end seal 71 positioned substantially transverse to the longitudinal heat seal 70, an opposing second trailing end seal 72 positioned substantially transverse to the longitudinal seal 70, a first side edge 73, and an opposing second side edge 74. As depicted, first side edge 73 and an opposing second side edge 74 are each positioned between first leading end seal 71 and opposing second trailing end seal 72. Preferably, first leading end seal 71 and opposing second trailing end seal 72 are each a heat seal or cold seal, and more preferably, a heat seal. Preferably, first leading end seal 71 and opposing second trailing end seal 72 are each configured as a fin seal.

Front panel 51 includes a continuous seal 75 which continuously circumscribes the recessed cavity 30 and comprises an inner perimeter defined by heat seal 76 formed by heat sealing a portion 53 of the front panel 51 to the peripheral flange 40. In one embodiment of the invention, continuous seal 75 is hermetic. It will be appreciated that portion 53 of front panel 51 covers recessed cavity 30 which then hermetically seals any food item 11 within container 10. This reduces the cost of packaging by eliminating the need for a separate lidding film. Portion 53 also provides a relatively smooth surface for printing of indicia 53*a*. Printing onto portion 53 may include graphics or colors to make package 10 more attractive to a potential consumer. Alternatively, portion 53 may be transparent and used for viewing of the food item 11 contained within package 10 by a consumer. In addition, back panel 52 may be used to place other indicia 53*a*, such as mandated by local food labeling laws, as well as, cooking instructions which may be desired to be placed on the package 10. In this way, the extra cost of a separate printed paperboard overwrap sleeve or a separate paperboard carton can now be eliminated by printing directly onto to front panel 51 and/or back panel 52 of package 10.

In accordance with an important aspect of the present invention, package 10 further includes a manually removable portion 60 of front panel 51 having an outer periphery defined by a line of weakness 65 in laminate 80. As depicted, the outer periphery of manually removable portion 60 is inside the inner perimeter of continuous hermetic seal 75. The general shape of removable portion 60 is defined by line of weakness 65 and facilitates the opening of package 10. Line of weakness 65 may have a depth through the entire thickness of laminate 80 or a depth through less than the entire thickness of laminate 80. Preferably, line of weakness 65 has a depth through less than the entire thickness of laminate 80. Line of weakness 65 may be made as a score-line by optical ablation using a laser to any depth in the top surface or bottom surface laminate 80, but preferably to a depth of from about 50-95% of the thickness of laminate 80.

Line of weakness 65 may have any shape, width or length provided that its placement is on front panel 51, and is positioned at a location inside the periphery of recessed cavity 30. Alternatively, line of weakness 65 may have any shape, width or length provided that its placement is on front panel 51, and preferably, is positioned at a location outside the periphery of recessed cavity 30 (not shown). In one embodiment, line of weakness 65 is positioned at a location inside the perimeter of heat seal 76. In a preferred embodiment, line of weakness 65 has a shape which substantially replicates the shape of at least a portion of recessed cavity 30. In another preferred embodiment, line of weakness 65 has a shape which substantially replicates the shape of the entire recessed cavity 30. In an alternative embodiment, line of weakness 65 is provided as two or more lines. Line of weakness 65 may be made as a continuous or non-continuous cut, groove or indentation in either the top or bottom surface of laminate 80.

It is further contemplated that removable portion 60 may include a pull-tab 66 which further facilitates the opening of package 10. Pull-tab 66 may be provided as a separate adhesive label being pieced at any position on removable portion 60. In one preferred embodiment, pull-tab 66 includes a first edge permanently affixed to removable portion 60 and an opposing second edge peelably affixed removable portion 60. In another embodiment, includes a first edge peelably affixed to removable portion 60 and an opposing second edge peelably affixed removable portion 60. The most preferable location for the pull-tab is approximately at the midpoint of the line of weakness 65.

Preferably, thermoplastic overwrap 50 comprises a material which will not melt or otherwise deteriorate during heating of the food items 11 in a microwave oven. Preferably, thermoplastic overwrap 50 is constructed from a material that will sufficiently not retain heat to prevent discomfort or burning to the consumer upon handling following microwave cooking. It will be appreciated that the choice of materials used to form overwrap 50 may be determined by the nature of the food items 11 to be packaged in the package 10. For example, packaging of refrigerated foods, overwrap 50 must be substantially impermeable to gases and/or water vapor. Packaging for refrigerated foods will often include oxygen barrier materials such as one or more layers of polyamide and ethylene vinyl alcohol copolymer. Alternatively, packaging pre-sterilized and sterile products, e.g., dairy products, puddings, desserts, fruit, vegetable juices, soups, sauces and the like, overwrap 50 must be capable of withstanding aseptic packaging process conditions. Aseptic packaging process conditions are well-known in the art. Further, it is preferred that the thermoplastic overwrap material allow for tearing or opening to permit easy access to the food items 11 contained within package 10. The constructions of the overwrap of the invention will be discussed in greater detail below.

Figure 5:
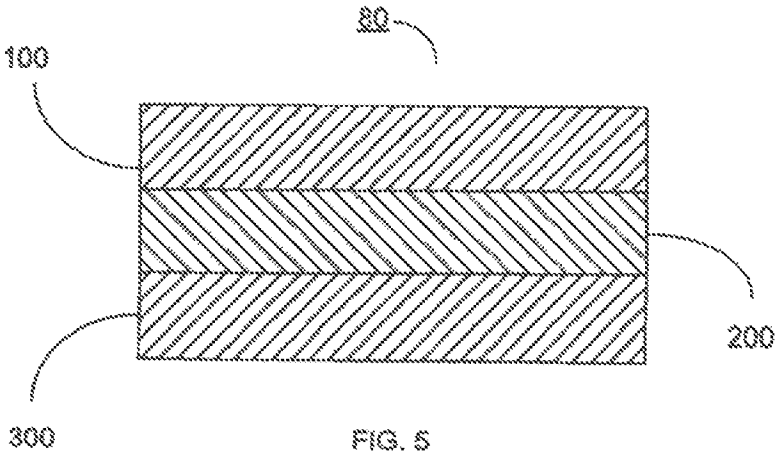
FIG. 5 depicts a cross-sectional view of a general embodiment of a polymeric film structure suitable for use as an overwrap with the present invention.

FIG. 5 is a cross-sectional view of an example of a preferred embodiment of a thermoplastic overwrap 50 comprising a polymeric laminate 80. As depicted, laminate 80 includes a multilayer structure formed by lamination of a first film 100 of polyethylene terephthalate to a second film 300 via an adhesive layer 200. In an alternative example, film 100 may include polyimide, polypropylene, polystyrene or polyethylene. Preferably, film 100 is oriented, more preferably, uniaxially oriented in either the machine direction or transverse direction and more preferably, biaxially oriented in both the machine direction and the transverse direction. Preferably, film 100 is a biaxially oriented polyethylene terephthalate film which is heat annealed to render the film substantially non-heat shrinkable, e.g., a film having a heat shrinkage of less than about 15%, more preferably, less than 10% and most preferably, less than 5% in either the machine and/or transverse direction. The total thickness of film 100 is generally from about 42 gauge to about 48 gauge (or about 10.67 microns to about 12.19 microns), typically, from about 44 gauge to about 48 gauge (or about 11.18 microns to about 12.19 microns).

In one embodiment, second film 300 is a monolayer (as shown in FIG. 3) Second film 300 may comprise any polyolefin including, but not limited to, polyethylene, preferably, low density polyethylene, and more preferably, linear low density polyethylene, polypropylene or combinations thereof. In another alternative embodiment, second film 300 may have any number of layers depending on the functional properties desired. In alternative embodiments, second film 300 may include a water vapor barrier material and/or an oxygen barrier material, and more preferably, includes both includes a water vapor barrier material and an oxygen barrier material. Second film 300 may be formed by coextrusion of one or more polymeric materials by cast coextrusion or blown coextrusion techniques. Preferably, second film 300 is formed by blown coextrusion methods. The total thickness of second film 300 is generally from about 12.7 μm (0.5 mil) to about 254 μm (10 mil), typically from about 50.8 μm (2 mil) to about 178 μm (7 mil), most typically from about 63.5 μm (2.5 mil) to about 127 μm (5 mil).

In accordance with the present invention, second film 300 may be a multilayered film which includes oxygen barrier materials that provides an oxygen transmission rate of less than about 1.0 $cm^3/100\ in^2/24$ h at 73° F., 0% RH and 1 atm (or about 15.5 $cm^3/m^2/24$ h at 23° C., 0% RH and 1 atm), preferably, less than about 0.5 $cm^3/100\ in^2/24$ h at 73° F., 0% RH and 1 atm (or about 7.75 $cm^3/m^2/24$ h at 23° C., 0% RH and 1 atm), and most preferably, about 0.2 $cm^3/100\ in^2/24$ h at 73° F., 0% RH and 1 atm (or about 3.1 $cm^3/m^2/24$ h at 23° C., 0% RH and 1 atm). In accordance with the present invention, second film 300 includes water barrier materials, such as a polyolefin which that provides a water vapor transmission rate less than about 1.0 $g/100\ in^2/24$ h at 73° F., 90% RH and 1 atm (or about 15.5 $g/m^2/24$ h at 23° C., 90% RH and 1 atm) and preferably, about 0.2 $g/100\ in^2/24$ h at 73° F., 90% RH and 1 atm (or about 3.1 $g/m^2/24$ h at 23° C., 90% RH and 1 atm).

The following example illustrates a certain particular embodiment of a polymeric laminate suitable for use as an overwrap in the present invention and is not to be interpreted as limiting. In the following example, resin composition percentages are based on the total weight of each film layer. In the following example, first film 100 was purchased as free-standing film which was adhesively laminated via adhesive layer 200 to a free-standing second film 300.

Example 1 is one embodiment of a polymeric laminate suitable for use as a thermoplastic overwrap of the present invention having a structure 80 as illustrated in FIG. 3. A reverse printed biaxially oriented polyethylene terephthalate (OPET) (48-gauge Jindal J-201 OPET supplied by Jindal Poly Films Ltd., New Delhi, INDIA) was bonded with a standard solventless laminating adhesive (PURELAM® 6000 (prepolymer)/6050 (curative), available from Ashland Inc.) to a white, 2.0 mil thick film of linear low density polyethylene (LLDPE). It is to be appreciated that other layers could be positioned between the oriented polyethylene terephthalate (OPET) and the linear low density polyethylene layer depending on the desired properties of the resulting laminate. For this example, the resulting laminate had the following structure: OPET/Ink/Adhesive/LLDPE.

The manually openable packages of the present invention may be formed and assembled in a variety of manners. One exemplary process for producing the packages includes providing a first film and reverse printing onto this film followed by adhesively laminating a second film to the first film to form the overwrap laminate. Adhesive lamination techniques or other well-known lamination methods may be used for securing the first film to the second film. Once the overwrap laminate is formed, either the outer or inner surface of the overwrap is scored to provide at least one line of weakness. As mentioned previously, the line of weakness in the overwrap laminate is used to define, in part, the shape of the removal portion of the front panel. It will be appreciated that if the overwrap includes a barrier film, e.g., one or more layers of barrier material, the scoring is performed in such a manner as to not affect the barrier properties of the laminate. The line of weakness may be produced by mechanical means such as, for example, cutting blade or roller. Preferably, the line of weakness is produced by optical ablation using a laser beam which affords more control over the shape, size and depth of penetration of the scoring.

Preferably, the line of weakness, is in register with any printed pattern provided on the surface of the overwrap. By controlling the motion between the material being processed and the laser beam, and/or the intensity of the laser beam, the desired dimensions of the line of weakness, i.e., depth and radius, may be obtained. Accordingly, a preferred embodiment of the present invention, a single continuous line of weakness in the external surface of the overwrap is provided which penetrates to a depth of from about 50-95% of the thickness of the laminate. Another preferred embodiment of the present invention, a non-continuous line of weakness in the external surface of the overwrap is provided which penetrates to a depth of from about 50-95% of the thickness of the laminate. In one embodiment, the line of weakness is at a location inside the periphery of the recessed cavity and has a shape which substantially replicates the shape of the recessed cavity. As such, the general dimensions of the line of weakness including its length and shape will depend upon shape of the recessed cavity of the tray.

After providing the line of weakness, the tray is filled with a food product and the overwrap is placed over the tray and sealed to the flange of the tray. Preferably, overwrap is sealed to the tray such that a continuous seal is formed circumscribing the perimeter of the recessed cavity. Preferably, the overwrap is sealed as a heat seal. Heat sealing can be achieved by bringing the surface of the overwrap into contact the surface of the flange and then applying sufficient heat and pressure to a predetermined area of the two surfaces to cause the contacting surfaces to become molten and intermix with one another, thereby forming as essentially inseparable fusion bond between the two surfaces in the predetermined area when the heat and pressure are removed therefrom and the area is allowed to cool. In one embodiment, the heat seal of the overwrap to the flange of the tray is a non-hermetic heat seal. In another embodiment, the heat seal of the overwrap to the flange of the tray is a hermetic heat seal. Once the overwrap is sealed to the flange of the tray, the overwrap is folded around the tray and a longitudinal seal is formed underneath the base of the tray. Preferably, the longitudinal seal is configured as a fin seal. Alternatively, the longitudinal seal can be configured as a lap seal. Sealing the overwrap underneath the base of the tray forms the front panel and the opposing back panel of the package. It is preferred to form the longitudinal seal as a heat seal.

After forming the longitudinal seal, a first leading end seal positioned substantially transverse to the longitudinal seal and an opposing second trailing end seal positioned substantially transverse to the longitudinal seal are then formed. Preferably, each of the end seals are formed as fin seals by heat sealing the inner surfaces of the front and back panels together which extend beyond the perimeter of the tray. After the end seals are formed, the leading end and trailing end of the overwrap are cut to individualize each package.

In an alternative method, the overwrap is first folded around the tray and a longitudinal seal is formed underneath the base of the tray. After forming the longitudinal seal, a first leading end seal positioned substantially transverse to the longitudinal seal and an opposing second trailing end seal positioned substantially transverse to the longitudinal seal are then formed. Following formation of the ends seal, the overwrap is then heat sealed to the flange of the tray. The heat sealing of the overwrap to the tray flange may be accomplished such a manner known to those skilled in the art so that either a hermetic or non-hermetic heat seal is formed.

Once package has been individualized, a separate pull-tab is adhesively applied to the removable portion of the package at a location near or on the line of weakness. Preferably, the pull-tab is placed at a location which generally corresponds to the mid-point on the line of weakness. The pull-tab may have at least a first edge which is permanently affixed to the removable portion of the front panel. The pull-tab may further have an opposing second edge which is peelably affixed to the front panel of the package.

The invention claimed is:

1. A manually openable package comprising:

a rigid or semi-rigid tray having a base and at least one sidewall extending from said base thereby forming a recessed cavity; wherein said at least one sidewall comprises a peripheral flange extending generally perpendicularly from said at least one sidewall and circumscribing said recessed cavity;

a single thermoplastic overwrap surrounding said tray and comprising a polymeric laminate; wherein said overwrap comprises a front panel and an opposing back panel comprising a longitudinal seal, a first leading end seal positioned substantially transverse to said longitudinal seal, an opposing second trailing end seal positioned substantially transverse to said longitudinal seal;

a continuous seal circumscribing said recessed cavity and comprising an inner perimeter defined by a heat seal formed by heat sealing a portion of said front panel to said peripheral flange; and a removable portion of said front panel having an outer periphery inside said inner perimeter of said seal and defined by a line of weakness in said polymeric laminate, wherein the front panel of the overwrap is sized to extend beyond both the continuous seal and the peripheral flange.

2. The package according to claim 1, wherein said continuous seal circumscribing said recessed cavity is a hermetic heat seal.

3. The package according to claim 1, wherein said package is self-venting.

4. The package according to claim 1, wherein said removable portion of said front panel further comprises a pull-tab having at least a first edge permanently affixed to said removable portion.

5. The package according to claim 4, wherein said pull-tab further comprises an opposing second edge peelably affixed to said front panel.

6. The package according to claim 4, wherein said pull-tab is positioned at approximately the midpoint of said line of weakness.

7. The package according to claim 1, wherein said line of weakness is configured to rupture at approximately the midpoint of said line of weakness.

8. The package according to claim 1, wherein said line of weakness is at a location inside the periphery of said recessed cavity.

9. The package according to claim 1, wherein said line of weakness has a depth less than the thickness of said laminate.

10. The package according to claim 1, wherein said line of weakness is continuous.

11. The package according to claim 1, wherein said longitudinal seal is a heat seal.

12. The package according to claim 1, wherein said first leading end seal and said opposing second trailing end seal are each a heat seal.

13. The package according to claim 1, wherein said longitudinal heat seal is a fin seal.

14. The package according to claim 1, wherein said longitudinal heat seal is a lap seal.

15. The package according to claim 1, wherein said package is a microwavable package.

16. The package according to claim 1, wherein said package is an aseptic or retortable package.

17. The package according to claim 1, wherein said package is a cook-in package.

18. The package according to claim 1, wherein said overwrap further comprises printed indicia.

19. A self-venting manually openable microwave package for use in heating a food item, the package comprising:

a rigid or semi-rigid tray having a base and at least one sidewall extending from said base thereby forming a recessed cavity; wherein said at least one sidewall comprises a peripheral flange extending generally perpendicularly from said at least one sidewall and circumscribing said recessed cavity;

a single thermoplastic overwrap surrounding said tray and comprising a polymeric laminate; wherein said overwrap comprises a front panel and an opposing back panel comprising a longitudinal heat seal disposed underneath said base of said tray, a first leading end heat seal positioned substantially transverse to said longitudinal seal, an opposing second trailing end heat seal positioned substantially transverse to said longitudinal seal, a first side edge and an opposing second side edge, wherein said side edges are positioned between said first leading end heat seal and said opposing second trailing end heat seal;

a continuous seal circumscribing said recessed cavity and comprising a hermetic heat seal formed by heat sealing a portion of said front panel to said peripheral flange; and a removable portion of said front panel having an outer periphery inside said inner perimeter of said hermetic seal and defined by a line of weakness in said polymeric laminate; wherein said line of weakness is configured to rupture and release steam in response to overpressure generated during heating of said food item;

wherein said front panel comprises a pull-tab having at least a first edge permanently affixed to said removable portion, wherein the front panel of the overwrap is sized to extend beyond both the continuous seal and the peripheral flange.

20. The package according to claim 19, wherein said line of weakness is configured to rupture at approximately the midpoint of said line of weakness.

* * * * *